US011253044B2

(12) United States Patent
Tubbs

(10) Patent No.: US 11,253,044 B2
(45) Date of Patent: Feb. 22, 2022

(54) PRO SPONGE REJUVENATOR

(71) Applicant: Asia Royal Tubbs, Jacksonville, FL (US)

(72) Inventor: Asia Royal Tubbs, Jacksonville, FL (US)

( * ) Notice: Subject to any disclaimer, the term of this patent is extended or adjusted under 35 U.S.C. 154(b) by 0 days.

(21) Appl. No.: 16/856,455

(22) Filed: Apr. 23, 2020

(65) Prior Publication Data

US 2020/0337443 A1 Oct. 29, 2020

Related U.S. Application Data

(60) Provisional application No. 62/837,313, filed on Apr. 23, 2019.

(51) Int. Cl.

| | |
|---|---|
| ***A45D 44/00*** | (2006.01) |
| ***B08B 3/10*** | (2006.01) |
| ***B08B 1/04*** | (2006.01) |
| ***A47L 25/00*** | (2006.01) |

(52) U.S. Cl.

CPC ..... *A45D 44/00* (2013.01); *A47L 25/00* (2013.01); *B08B 1/04* (2013.01); *B08B 3/102* (2013.01)

(58) Field of Classification Search

CPC .. B08B 1/001; B08B 3/04; B08B 1/04; A47L 13/58; A47L 13/59

See application file for complete search history.

(56) References Cited

U.S. PATENT DOCUMENTS

| | | | | |
|---|---|---|---|---|
| 4,674,903 | A | 6/1987 | Chen | |
| 4,710,233 | A * | 12/1987 | Hohmann | A61L 2/035 205/701 |
| 4,983,221 | A * | 1/1991 | Kaiser | B08B 1/007 134/6 |
| 8,336,563 | B2 | 12/2012 | Guenther et al. | |
| 9,380,860 | B1 | 7/2016 | Taylor | |
| 2004/0123885 | A1* | 7/2004 | Myong | B08B 3/02 134/168 R |
| 2014/0096801 | A1 | 4/2014 | McCormick et al. | |
| 2017/0119145 | A1 | 5/2017 | Munoz | |

FOREIGN PATENT DOCUMENTS

| | | | | |
|---|---|---|---|---|
| WO | WO-2007063540 A2 * | 6/2007 | | B08B 9/36 |

* cited by examiner

*Primary Examiner* — Natasha N Campbell
(74) *Attorney, Agent, or Firm* — Carson Patents; Gregory D Carson

(57) ABSTRACT

The Pro Sponge Rejuvenator is sponge cleaner for cleaning a plurality of used sponges, comprising: a liquid-tight container in which stems which extend from a platform toward a bottom of the container are oscillate-able to rub the sponges against the bottom by an oscillation means connected to the platform and supported by the bottom. The Pro Sponge Rejuvenator cleans sponges using a cleaning solution that is filtered with every sponge cleaning oscillation up/down stroke of the apparatus through the use of one-way flow valves under the sponges and a central tube with filter media. The Pro Sponge Rejuvenator is ideal for cleaning sponges and especially cosmetics makeup sponges.

15 Claims, 2 Drawing Sheets

PRO SPONGE REJUVENATOR

TECHNICAL FIELD OF THE INVENTION

The present invention relates generally to an apparatus for cleaning sponges. More specifically, the present invention relates to an apparatus for simultaneously cleaning multiple makeup sponges.

BACKGROUND

Makeup sponges are often essential in the application of cosmetics. After the application of cosmetics, the used makeup sponges need to be cleaned in preparation for future applications of cosmetics. Used makeup sponges are difficult to clean as the used makeup sponges require lots of agitation to remove any leftover cosmetics products that are stuck in the pores of the used makeup sponge. Currently, the most common method to clean used makeup sponges is scrubbing the used makeup sponges by hand under running water. However, the process of scrubbing used makeup sponges by hand covers minimal surface area with every scrubbing motion making the process inefficient and tiring. As a result, there is a need for a solution that can efficiently scrub the entire surface area of used makeup sponges.

The process of scrubbing used makeup sponges by hand is also limiting as only one used makeup sponge can be cleaned at a time. This limitation often results in beauticians and beauty salons running out of clean makeup sponges to be used for the application of cosmetics. Therefore, there is a need for a solution that can clean a plurality of used makeup sponges simultaneously.

BRIEF SUMMARY OF THE INVENTION

According to a first aspect of the invention, there is a sponge cleaner for cleaning a plurality of used sponges, comprising: a liquid-tight container divided into compartments, and an oscillate-able platform from which stems extend into the compartments toward a cleaning surface supported by a bottom of the container to rub the sponges between the cleaning surface and stems. Preferably, the cleaning surface is a screen which is preferably permeable to cleaning liquid.

The present invention is an apparatus for cleaning a plurality of used sponges simultaneously and efficiently within a cleaning fluid while filtering and cleaning the cleaning fluid. The present apparatus can maximize the amount of surface area scrubbed with every scrubbing motion, and it filters and removes the detritus from the cleaning solution to further enhance the utility and efficacy of the cleaning fluid thereby enhancing the cleaning of the sponges inserted therein. The maximization of surface area scrubbed with every scrubbing motion allows used sponges to be cleaned effectively and efficiently with minimal cleaning time and effort. The filtration of the cleaning fluid allows used sponges to be cleaned effectively and efficiently with minimum cleaning time and effort by continually offering clean/filtered cleaning fluid for each stroke of the apparatus.

According to a second aspect of the invention, there is a method of using the sponge cleaner disclosed herein to clean sponges by placing the sponges to be cleaned upon said cleaning platform, closing the apparatus with said cover, and oscillating said platform to clean the sponges in an up-down and twisting motions.

The invention will now be described, by way of examples only, with reference to the accompanying drawings in which:

DETAILED DESCRIPTION OF THE INVENTION

Figure 1:
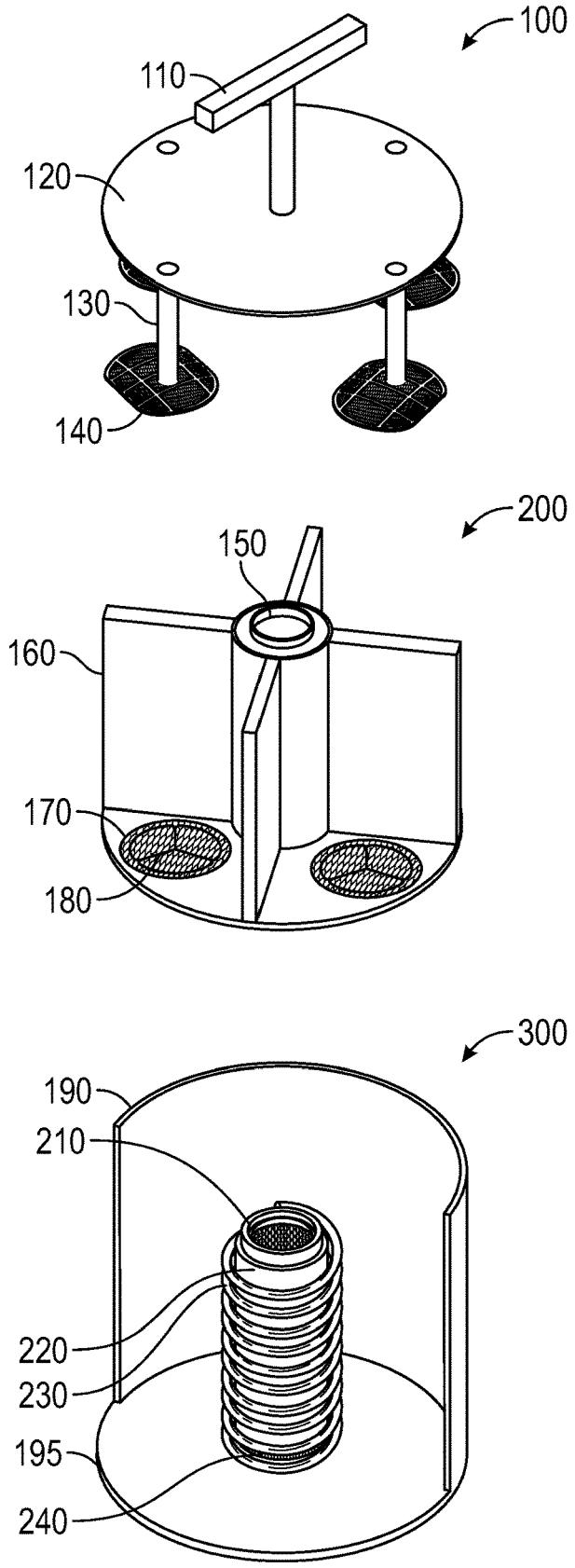
FIG. 1 is an exploded view of a first embodiment of a sponge cleaner according to the invention, and, FIG. 2 is an exploded view of a second embodiment of a sponge cleaner according to the invention.

FIG. 1 is an exploded view of a sponge cleaner for cleaning a plurality of used sponges. The sponge cleaner may be referred to as Pro Sponge Rejuvenator. After a used or makeup containing sponge is cleaned of makeup and skin oil by the sponge cleaner, the cleaned sponge is like a new sponge. Element 100 is a cover or top device comprising a handle (110) connected to a platform (120). The handle (110) is for a user to manually oscillate the cover or top device (100) so as to clean the sponges. The platform (120) is arranged to close an opening of a liquid-tight container (300). The platform (120) is a sealing cover plate or dome. Stems (130) are shafts connectively attached to the water-tight sealing cover plate (120). Positioned on an end of the stems (130) distal from the cover (120) are sponge holding screens or grates (140) connectively attached to the stems (130). Illustrated in FIG. 1 is a sponge cleaner for cleaning a plurality of used sponges, comprising: a liquid-tight container (300) in which stems (130) which extend from a platform (120) toward a bottom (195) of the container are oscillate-able to rub the sponges against the bottom by an oscillation means connected to the platform (120) and supported by the bottom. It is not essential that the sponges be rubbed against the bottom (195) of the container (300) because the sponges may alternatively be rubbed against a base (270) of a sponge cleaning and drying tray (500) inside the container (300). The base (270) is supported by the bottom (195).

Element 200 is a sponge cleaning tray which inserts into the liquid tight container (300). The sponge cleaning tray (200) comprises element (150) which is a soap or cleaning fluid dispensing device situated at the top of a water return opening in the center of the sponge cleaning tray (200). The sponge cleaning tray (200) comprises an element (160) which is sponge separation walls. These walls are a divider to prevent cross contamination between the various sponge cleaning areas of the sponge cleaning tray (200). Element 170 is a sponge cleaning position screen connectively attached to the sponge cleaning tray (200). The sponge separation walls (160) extend perpendicularly from a floor in the sponge cleaning tray. The floor comprises the sponge cleaning positioning screen (170). Element 180 is one-way flow valves which are connectively attached to the floor of the sponge cleaning tray (200) and situated under each of the sponge cleaning position screens (170). The sponge separation walls (160) divide the sponge cleaning tray (200) and the liquid tight container (300) into compartments. Each one of the compartments has one of the sponge cleaning positioning screens (170).

Element 300 is the liquid-tight container and is a base unit device of the sponge cleaner. Element 190 is the outer water-tight container sides and element 195 is the bottom. Element 210 is filter media for filtering the cleaning solution. The filter media is situated in a tube which extends perpendicularly from the bottom (195). Element 220 is the filter-media water flow tube. Element 230 is a lift spring which surrounds the tube (220) and is supported by the bottom (195). Element 240 is an openings or screen situated at the bottom distal end of the filter media water flow tube (220) proximate to where the tube (220) is connected to the bottom (195) of the container.

Figure 2:
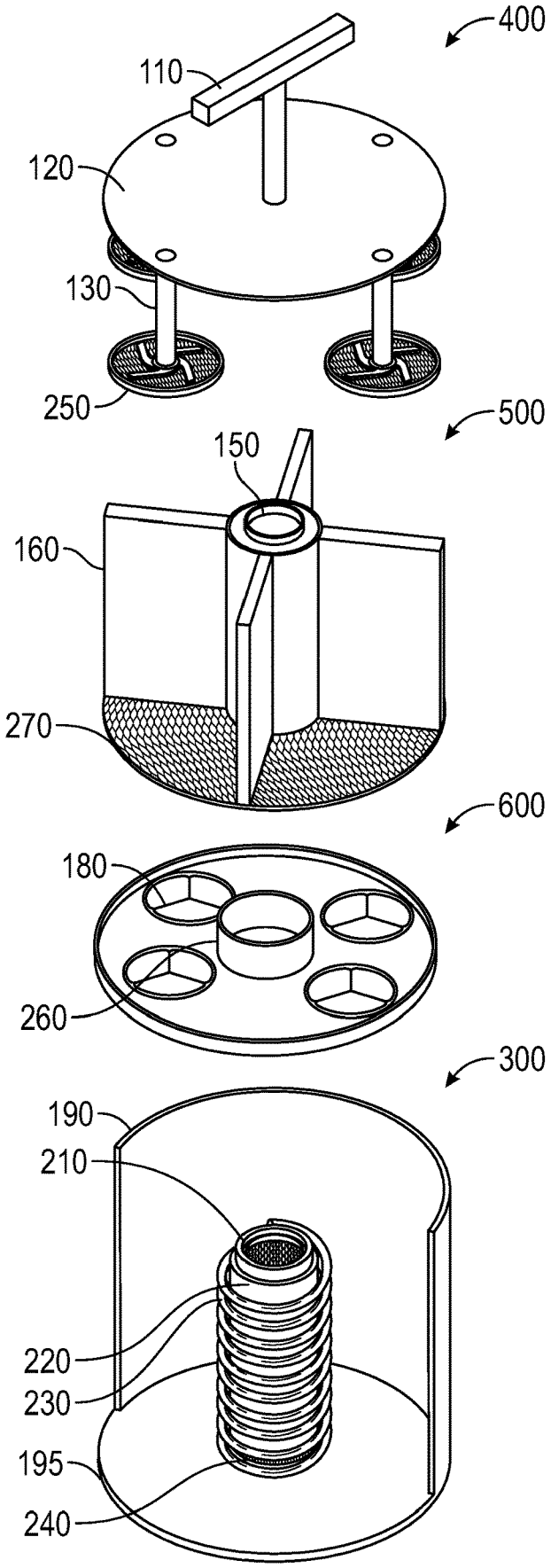

Illustrated in FIG. 2 is a second embodiment of the sponge cleaner for cleaning a plurality of used sponges, comprising: a liquid-tight container (600) in which stems (130), which extend from a platform (120) toward a bottom (195) of the container, are oscillate-able to rub the sponges against the bottom (195) by an oscillation means connected to the platform (120) and supported by the bottom. It is not essential that the sponges be rubbed against the bottom (195) of the container (300) because the sponges may alternatively be rubbed against a base (270) of a sponge cleaning and drying tray (500) inside the container (300). The base (270) is supported by the bottom (195) of the container (300). FIG. 2 shows an exploded view of a manually operable version of a preferred embodiment of the Pro Sponge Rejuvenator sponge cleaner. Element 400 is a cover or top device with modular sponge holders. The cover (400) comprises an element 110 which is a handle to oscillate the cover (400). Element 120 is a water-tight sealing platform or plate or dome to which the handle (110) is centrally connected. Element 130 is the stems or shafts connectively attached to the water-tight sealing platform (120). The stems (130) extend from the opposite side of the platform (120) to the stems. The stems (130) extend into a liquid tight container (600) when the platform (120) is placed over the opening of container (600). Element 250 is a modular sponge holding screen or grate connectively attached to the stems (130) further comprising sponge twisting, smashing, and squeezing arms which are mechanically moved with upward and downward motion of the handle (110).

Element 500 is the sponge cleaning tray modified to become a sponge cleaning and drying tray. Element 150 is a soap or cleaning fluid dispensing device situated at the top of a water return opening in the center of the sponge cleaning and drying tray (500). Element 160 is sponge separation walls which are a divider to prevent cross contamination between the various sponge cleaning areas of the sponge cleaning and drying tray (500). The sponge separation walls 160 extend perpendicularly to a base (270) of the tray (500) so as to form compartments having an open top to receive the stems (130) and grates (250). Element 270 is the drying screen comprising the bottom of the sponge cleaning and drying tray (500). In use, the sponges are compressed between the grates (250) and the base (270). A user manually oscillates the stem (130) and grates (250) by oscillating the handle (110) connected to the platform (120). The sponges are then rubbed by the grates (250) and the base (270) to clean the sponges.

Element 600 is a one-way valve tray which fits underneath the sponge cleaning and drying tray (500) and intermediate the tray screen (270) and the bottom (195) of the container (300). The one-way valve tray (600) enables the sponge cleaning and drying tray (500) to drain cleaning fluid in the compartments formed by the divider walls (160) beneath said one-way valve tray (600) when the sponge cleaner is in use cleaning sponges. Element 180 is the one-way flow valves which are connectively attached to the sponge cleaning tray (600). There is a one-way valve (180) beneath each compartment formed by the dividers (160). Element 260 is the water flow connection tube which is in liquid communication with the soap or cleaning fluid dispensing device (150).

Element 300 is the liquid-tight base unit container which houses the sponge cleaning tray (500) and the one-way valve tray (600). Element 190 is an outer water-tight container sides and element (195) is the bottom of the container. Element 210 is filter media for filtering the cleaning solution. Element 220 is the filter-media water flow tube which is in fluid communication with the soap or cleaning fluid dispensing device (150). Element 230 is a lift spring. Element 240 is openings or a screen situated at the bottom distal end of the filter media water flow tube (220) proximate to where the flow tube (220) is connected to the bottom (195) of the container (300).

The pro sponge rejuvenator apparatus is a sponge cleaner device comprising: a water-tight container (300); a cleaning platform (200 or 500) that slides into said water-tight container comprising a plurality of one-way valves (130) under a screen, mesh, or grate (170, or 270) and a plurality of divider members connectively attached to the cover (100, 400); a lid (120) that covers said water-tight container creating a water-tight seal with said water-tight container; a cleaning fluid filtering system tube (220) comprising a fluid entry screen (240) at the bottom distal end of the filter tube (220); fluid filter media (210) in the middle of said filter tube; and a cleaning solution storage compartment (150) at the upper distal end of the water flow tube of the cleaning tray (200, or 500); a plunger handle (110) connectively attached to the top of said cover (100, 400); and an oscillation means comprising a plurality of poles with grates positioned on the bottom of said poles and upon the bottom surface of said cleaning platform.

The sponge cleaner is an inventive apparatus for cleaning used sponges. The apparatus allows for a plurality of used sponges to be cleaned simultaneously, effectively, and efficiently. The apparatus cleans used sponges efficiently by maximizing the amount of surface area on the used sponge that is scrubbed with every scrubbing motion by flattening and oscillation means. The apparatus cleans used sponges efficiently by filtering the detritus freed from cleaning solution used to clean the sponges prior to each scrubbing motion, thereby maximizing the efficacy of each oscillating scrubbing/cleaning motion.

The preferred embodiment of the apparatus comprises a water-tight container which houses a cleaning and drying platform/tray (500) that slides into said water-tight container which has a handle (110) connectively attached at the upper distal end, a lid (120) that covers said water-tight container creating a water-tight seal with said water-tight container (190), an oscillation means, a plurality of stems/poles (130) with modular grates/grids (140, or 250) positioned at the bottom end of said stem/pole to hold the sponges in place and to scrub and flatten the surface of the sponge(s) with each stroke, a divider member between sections where used sponges are placed for cleaning to separate different sponges, a plurality of one-way valves on a plate (600) for each sponge cleaning position within the apparatus, a cleaning fluid filtering system (220), a plunger handle (110), and a dome/cover (120).

The apparatus may be assembled with the water-tight container housing the cleaning platform/tray directly as shown in the Figures. Alternatively, as in the preferred embodiment, the cleaning and drying platform/tray is a separate container (500) that slides into the water-tight container (190) of the apparatus as shown in FIG. 2.

In the preferred embodiment, the modular cleaning heads (250) move up, down, and/or in circular rotation within the water-tight container to enable an oscillation motion to clean any sponges contained upon said cleaning and drying platform/tray (500). In the preferred embodiment, the cleaning and drying platform/tray moves up, down, and/or in circular rotation within the water-tight container when slid down over a central tube (220) comprising a fluid entry screen (240) at the bottom distal end of the central tube (220), a filter media section (210) in the middle of the central tube (220) for the placement of fluid filter media such as filter floss or activated charcoal, and a soap/cleaning solution storage and release mechanism (150) at the upper distal end of the water flow tube in the center of the cleaning and drying tray. In the preferred embodiment, the centrally located tube with fluid cleaning components is used to filter the cleaning fluid during each up and down cycle of the oscillation mechanism.

In the preferred embodiment, the cleaning platform further comprises an air drying rack/tray that is set upon, or rests upon, the cleaning platform (500). Alternatively said air drying rack/tray can be suspended above said cleaning platform, or suspended below said dome/cover. Radiant heat and/or a motorized fan connectively attached to the cover (400) may be used to further enhance the speed and efficiency of drying of the cleaned sponges.

In one embodiment, the screens, grates, or meshes (140) at the end of the poles (130) are replaced with plunger activated twisting shells (250) similar to the device of a self contained food chopper with blades replaced with rounded tabs to further smash, squish, and twist the sponge to be cleaned within the shell. The shell of this replacement head for the grate at the end of the stems is further comprised of a screen or mesh to permit free flow of the cleaning fluid into and around the sponge to be cleaned.

The filtration of the cleaning fluid is accomplished during each up and down stroke cycle of the oscillation mechanism. The up part of the oscillation stroke causes the cleaning tray to move up to the top of the apparatus releasing all of the cleaning fluid through the one-way valves under each sponge cleaning position within the apparatus, and the down part of the oscillation stroke then pushes the cleaning fluid up through the centrally located tube with fluid filtration components/elements filtering the cleaning solution and allowing the cleaning solution to flow up out of the top of the central fluid filtering tube resulting in the filtered cleaning fluid washing into the cleaning platform/tray for use during the downward part of the oscillation stroke to clean the sponges held in position by the poles with screens/grates at the bottom distal end against the screen covering the one-way valve located under each sponge cleaning position.

The oscillation mechanism/means is accomplished with the twisting and upward and downward motion of the handle, or by an electrically motorized means. The oscillation mechanism provides the physical motion needed to clean the used sponges. The oscillation mechanism is a plurality of poles/tubes attached to and/or passing through said water-tight cover that allows said oscillation mechanism to move up and down and be rotated or twisted in a circular fashion to smash, squeeze, and rub the inserted sponges to be cleaned. The oscillation mechanism comprises a shaft (tube/pole) with a grate connectively attached at the sponge contact end, and a platform with a grate on top of a downward flowing one-way fluid valve where sponge(s) is/are placed for cleaning.

In one embodiment of the apparatus, said oscillation mechanism shaft further comprises a spring, and the oscillation mechanism is purely mechanical and has no electrical components. Force can be applied to the spring, causing the shaft to move up and down. Twisting force can be applied to the handle, causing the shaft to rotate sideways, further rubbing, smashing, or squeezing the sponges to be cleaned.

In another embodiment of the apparatus, said oscillation mechanism shaft further comprises a motorized mechanism, and the oscillation mechanism is purely mechanical and has electrical components to drive the oscillating mechanism cleaning motion.

As shown in the Figures, the sponge cleaning heads are connected to the proximal (downward) end of the shafts or stems (130) attached to the cover (100, or 400). The water-tight cover (120) allows the plurality of stems (130) with attached modular sponge holders (140, or 250) to be attached and become a part of the oscillation mechanism. The cover (100, or 400) can be driven manually or with motorized means by the shaft to move up and down, and/or rotated/twisted side-to-side thereby scrubbing any sponges placed thereon. As in FIG. 1, the platform further comprises a plurality of grate/screen covered one-way valves (170) positioned in the center of the sponge treatment area in each section of the platform. Each grate/screen covered one-way valve corresponds to a member of the plurality of shafts/stems. The plurality of grate/screen covered one-way valves allows the plurality of stems to become a part of the oscillation mechanism by offering its screened top area to facilitate holding the sponge into position and allow cleaning fluid to pass down and away from the sponge being cleaned.

In reference to the Figures, the plurality of stems is attached to the platform with each individual member of the plurality of stems engaging with a corresponding member of the plurality of stems to trap and contain sponges to be cleaned. Each individual member of the plurality of stems can extend from the cover to the bottom of the cleaning tray. The attachment of each individual member of the plurality of stems to the platform allows each individual member of the plurality of stems to move in sync with the oscillation mechanism/means.

In the preferred embodiment of the apparatus, the sponge holders are modular sponge twisting, smashing, and squeezing arms over or under a screen used to hold sponges to be cleaned. The modular sponge twisting, smashing, and squeezing arms move in a fashion/manner like those of the blades internal to a conventional food chopper.

In an embodiment of the Pro Sponge Rejuvenator the rectangular divider walls (160) that separate the sponges have a grooved surface that can be pushed against the used sponge for cleaning. In other embodiments, the pad may be an egg-shaped pad, or any other suitable shape designed to hold sponges of a special shape or size. As the handle (110) is moved to create the oscillating cleaning motion, the sponges are pushed by an individual member of the plurality of stems into the dirty sponge, forcing the sponge to rub against the container and the divider walls to maximize the surface area being scrubbed in one scrubbing motion.

As shown in the embodiment in FIGS. 1-2, the divider walls may further provide grooved surfaces for the sponges to be pushed against. The divider walls (160) are attached to the bottom plate of the cleaning tray (200, or 500) and placed in the container. The divider comprises a plurality of walls and a center tube for the water filter tube (200) to be inserted. Each individual member of the plurality of walls is connected radially to the center tube. Each individual member of the plurality of walls has grooves and provides a surface suitable for scrubbing used/dirty sponges.

As shown in the embodiment in FIGS. 1-2, the device is cylindrically shaped. In other embodiments, the container may be in a variety of shapes. The container holds cleaning solution for cleaning used sponges. The cleaning solution helps loosen any detritus stuck on the surface and in the pores of the used sponge(s). The container may further comprise a bottom whose surface is studded and/or grooved to provide additional agitation surfaces for the scrubbing of sponges. Providing a non-flat surface with ridges or other surface deformations permits the surface to help clean the sponges by providing an additional rough surface for scrubbing the used sponges against with the oscillating motion.

In reference to FIGS. 1-2, the water-tight cover dome/lid (100, or 400) is attached to the container and prevents cleaning solution from leaving the container when the used sponges are being scrubbed with the oscillation means. In other embodiments, to include the preferred embodiment, the water-tight cover dome/lid (400) is attached to the cleaning platform/tray, and is a separate element.

In an alternative embodiment, the apparatus has electrical devices, elements, and/or components for automating the oscillating motion used to clean the sponges thereon. In an alternative embodiment, the apparatus additionally comprises an electrical motor for automating cleaning. The dome additionally comprises a fan and/or heating elements for drying the sponges after cleaning, and the dividers additionally comprise an ultraviolet light source for cleaning/sterilizing the sponges. The electrical motor, the fan, and the ultraviolet light source are all electrically connected and controlled with user accessible controls. The electrical motor is coupled with the spring or other mechanical motion generating device. The electrical motor drives the mechanical motion generating device, causing the oscillation mechanism to oscillate. The fan is attached to the dome and blow dries the used sponges that have been scrubbed, with or without heating from the heating elements The ultraviolet light source further cleans the used sponge by projecting ultraviolet light on the surface of the used sponge thus sterilizing the surface.

References in the specification to "one embodiment," "an embodiment," "an example embodiment," etcetera, indicate that the embodiment described may include a particular feature, structure, or characteristic; but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Furthermore, it should be understood that spatial descriptions (e.g., "above," "below," "up," "left," "right," "down," "top," "bottom," "vertical," "horizontal," etc.) used herein are for purposes of illustration only, and that practical implementations of the structures described herein can be spatially arranged in any orientation or manner.

All illustrations, figures, or drawings are for the purpose of describing selected versions of the present invention and are not intended to limit the scope of the present invention. Used makeup sponges refers to makeup sponges with left-over cosmetics products stuck in the surface/pores of the makeup sponges. Scrubbing motions refers to the motion required to scrub. This includes, but is not limited to, such actions as smashing, squeezing, or rubbing the sponge(s).

Although the invention has been explained in relation to various embodiments, it is to be understood that many other possible modifications and variations can be made without departing from the spirit and scope of the invention. The invention will now be further disclosed with reference to the claims.

The invention claimed is:

1. A sponge cleaner for cleaning a plurality of used sponges, comprising a liquid-tight container divided into compartments, and an oscillate-able platform from which stems extend into the compartments toward a cleaning surface supported by a bottom of the container to rub the sponges between the cleaning surface and stems and further comprising sponge cleaning grates positioned on an end of the stems distal from a cleaning platform.

2. The sponge cleaner of claim 1 wherein the grates are interchangeable.

3. The sponge cleaner of claim 1 comprising an attachable cover to close an opening in the container through which to insert and remove the sponges from the compartments.

4. The sponge cleaner of claim 3 wherein the attachable cover comprises the platform.

5. The sponge cleaner of claim 1 wherein the stems include a first end connected to the platform and a distal second end at a fixed distance from the bottom of the container.

6. The sponge cleaner of claim 5 where the stems have an oscillate-able length and/or twist with respect to the central axis of the stems.

7. The sponge cleaner of the claim 5 wherein the stems comprise a plurality of telescopic tubes.

8. The sponge cleaner of claim 5 further comprising oscillation means comprising a spring.

9. The sponge cleaner according to claim 5 wherein the stems further comprise an electrical actuator.

10. The sponge cleaner according to claim 1 further including a handle attached to the platform.

11. The sponge cleaner according to claim 1 comprising a divider extending from the cleaning surface, wherein the divider divides the interior of the container into the compartments.

12. The sponge cleaner according to claim 11 wherein the divider comprises walls from the cleaning surface up to the platform.

13. The sponge cleaner according to claim 1 wherein the cleaning surface is a screen.

14. The sponge cleaner of claim 13 further comprising an ultraviolet light source to clean the sponges.

15. A method of using a sponge cleaner to clean sponges consisting of the following steps:

A) selecting a sponge cleaner for cleaning a plurality of used sponges comprising a liquid-tight container divided into compartments, and an oscillate-able platform from which stems extend into the compartments toward a cleaning surface supported by a bottom of the container to rub the sponges between the cleaning surface and stems also including sponge cleaning grates positioned on an end of the stems distal from a cleaning platform;

B) placing the sponges on the stems;

C) closing the container; and,

D) activating the sponge cleaner to oscillate the sponges in an up and down and twisting motion.

* * * * *